United States Patent [19]

McFarland

[11] Patent Number: 4,757,740

[45] Date of Patent: Jul. 19, 1988

[54] MULTIPLE BARREL GUN

[76] Inventor: Douglas F. McFarland, Davis City, Iowa 50065

[21] Appl. No.: 56,381

[22] Filed: Jun. 1, 1987

[51] Int. Cl.[4] ..... F41F 1/04; F41D 7/00

[52] U.S. Cl. ..... 89/7; 89/1.41; 89/11

[58] Field of Search ..... 89/7, 9, 11, 1.41, 160, 89/126

[56] References Cited

U.S. PATENT DOCUMENTS

| | | | |
|---|---|---|---|
| 497,781 | 5/1893 | Gatling | 89/1.41 X |
| 563,701 | 7/1896 | Wilder | 89/11 |
| 3,992,976 | 11/1976 | Bartels et al. | 89/7 |
| 4,005,632 | 2/1977 | Holtrop | 89/7 |

*Primary Examiner*—David H. Brown

*Attorney, Agent, or Firm*—Zarley, McKee, Thomte, Voorhees & Sease

[57] ABSTRACT

Cylindrically arranged barrels include feeder rods connected to a wobble plate for reciprocally moving shells into a firing position. A back pressure seal sleeve may be positioned on the feeder rods. The sleeves include a forwardly tapering wall thickness whereby combustion pressures press the tapered wall sealingly against the feeder rods. An alternative sealing arrangement includes cut-off pins for each barrel which reciprocate transversely of the barrel in timed relation with the feeder pins. A cam rotates with a power shaft connected to the wobble plate and a nonrotating housing is positioned on the cam and is connected through linkage elements to the cut-off pins.

12 Claims, 3 Drawing Sheets

MULTIPLE BARREL GUN

BACKGROUND OF THE INVENTION

A nonrotating multiple barrel gun is needed which includes a minimum number of component parts for simplicity of operation and which may be liquid fired. Prior art guns have shortcomings including being too complicated and expensive and not being able to fire sufficient number of rounds per unit of time.

SUMMARY OF THE INVENTION

The multiple barrel gun of this invention includes parallel barrels which are nonrotating. A center power shaft is connected to a wobble plate which in turn is connected to a feeder rod extending into the rear ends of each of the barrels for reciprocally positioning the shell in a firing position.

A forward end of the feeder rod closes off the rear end of the combustion chamber when liquid fuel in the combustion chamber has been ignited. The back pressure seal sleeve embraces each feeder rod and includes a wall thickness which tapers forwardly such that combustion pressures seal the wall around the feeder rod.

An alternate embodiment includes a cam connected to the power shaft forwardly of the wobble plate with the cam rotating in a nonrotating housing which in turn in connected through linkages to cut-off pins extending tranversely of the barrels and reciprocally moving between open and close positions. In the closed position a cut-off pin insulates the end of the feeder pin from the combustion chamber and in the open position the cut-off pin is withdrawn from the chamber allowing the feeder pin to move the shell into a position for firing.

DESCRIPTION OF THE PREFERRED EMBODIMENT

Figure 1:
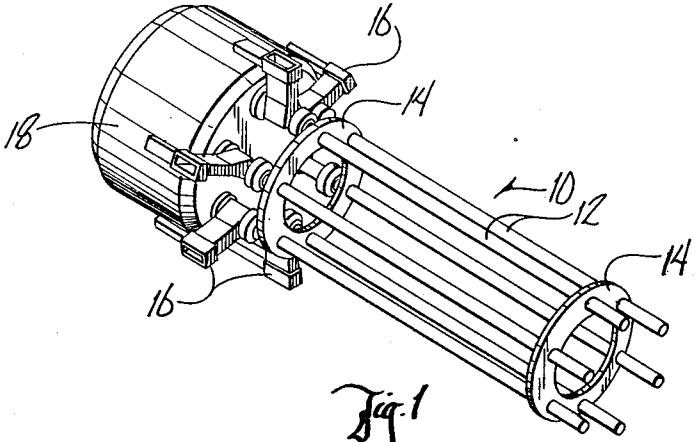
FIG. 1 is a perspective view of the multiple barrel gun of this invention.
Figure 6:
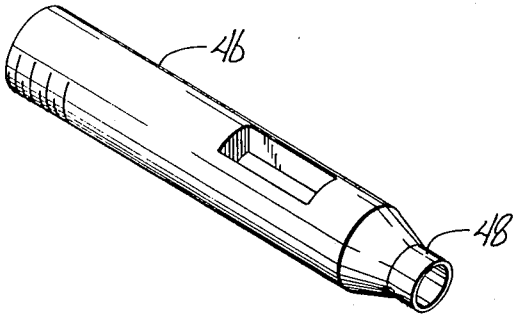
FIG. 6 is an enlarged perspective view of the back pressure seal sleeve which embraces each of the feeder pins.
Figure 2:
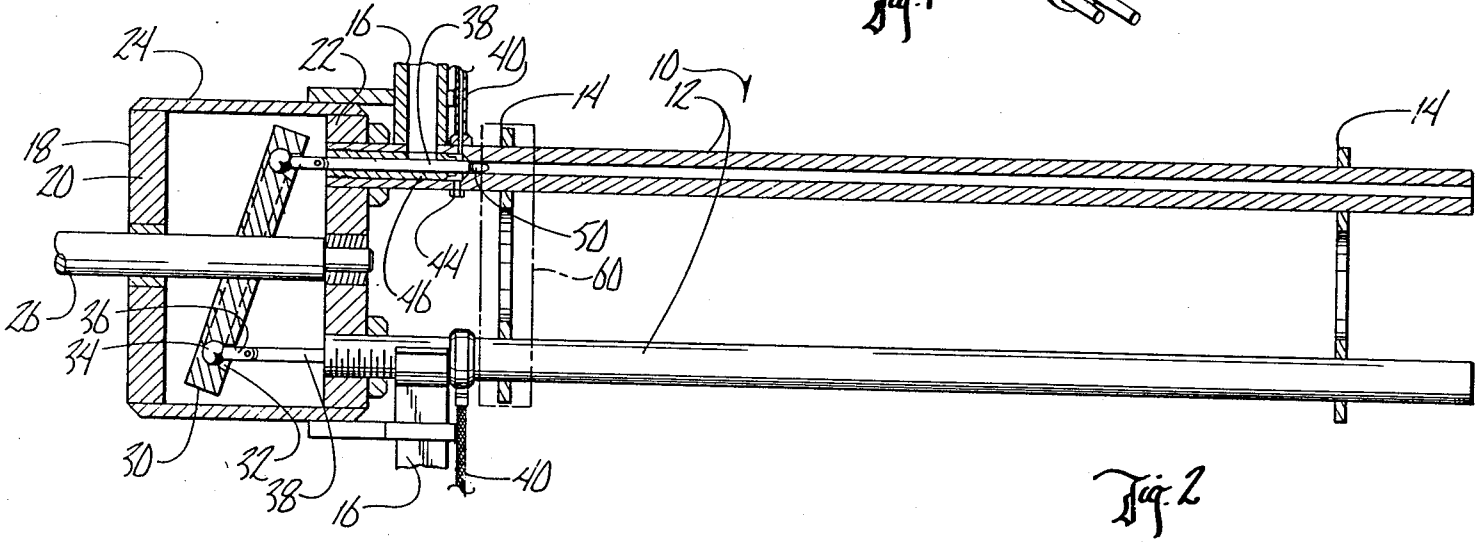
FIG. 2 is a longitudinal cross-sectional view thereof.

The multiple barrel gun of this invention is referred to in FIG. 1 generally by the reference numeral 10 and includes a plurality of barrels 12 arranged in a cylindrical configuration and interconnected by circular plates 14.

Individual shell feeder guides 16 are provided for each barrel 12.

A wobble plate drive assembly 18 includes a rear end wall 20 and a forward end wall 22 in a cylindrical housing 24. A drive shaft 26 extends through the rear end wall 20 with the forward end rotatably received in the forward end wall 22. A wobble plate 30 turns with the shaft 26 and includes a circular race 32 in which ball ends 34 on the linkage elements 36 are received. The linkage elements 36 are in turn pivotally connected to feeder pins 38 received in the rear ends of the barrels 12.

A liquid fuel line 40 is provided for feeding fuel into a combustion chamber 42 which includes an ignition coil 44.

A back pressure seal sleeve 46 embraces each of the pins 38 and includes a wall thickness which tapers at 48 forwardly such that combustion pressures in the combusition chamber 42 will press the thinner wall portion at the forward end of the sleeve tightly against the feeder rod 38 thereby preventing any gases from escaping along the feeder rod when combustion occurs.

Figure 3:
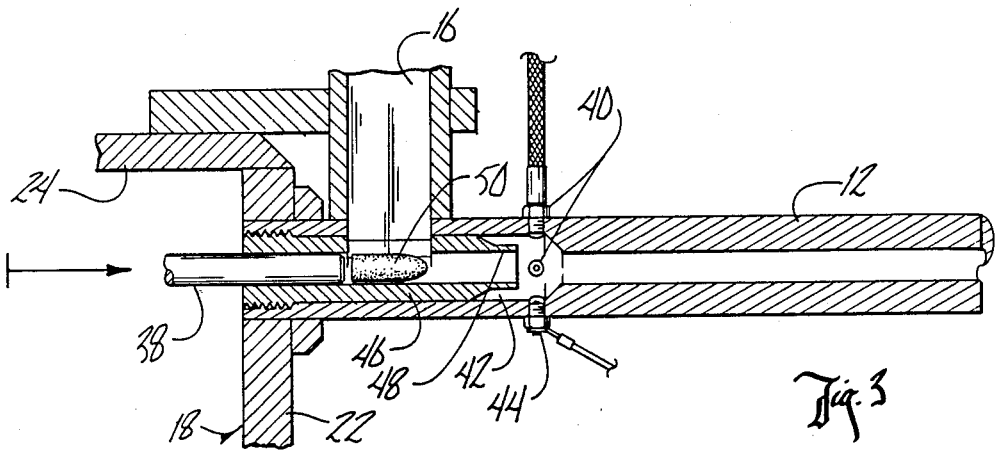
FIG. 3 is a fragmentary cross-sectional view of the feeder pin in its retracted position and the shell having just been received into the barrel.
Figure 4:
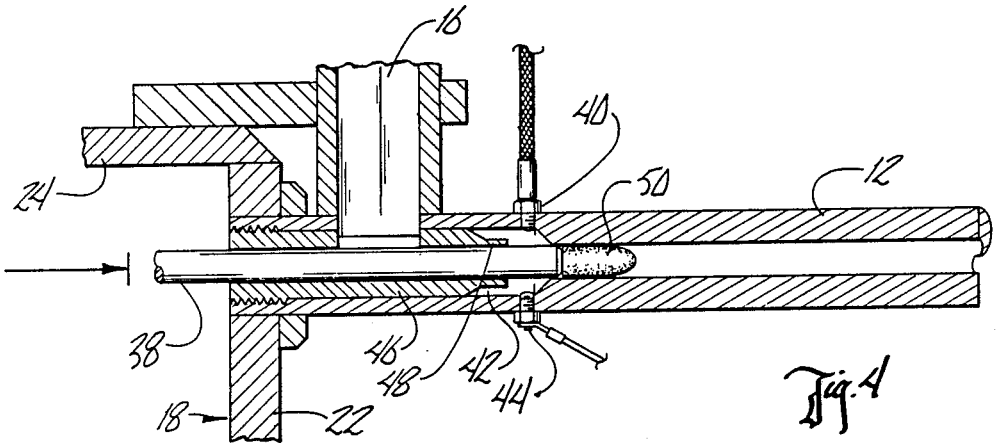
FIG. 4 is a view similar to FIG. 3 but showing the feeder pin advanced moving the shell into a position for firing.
Figure 5:
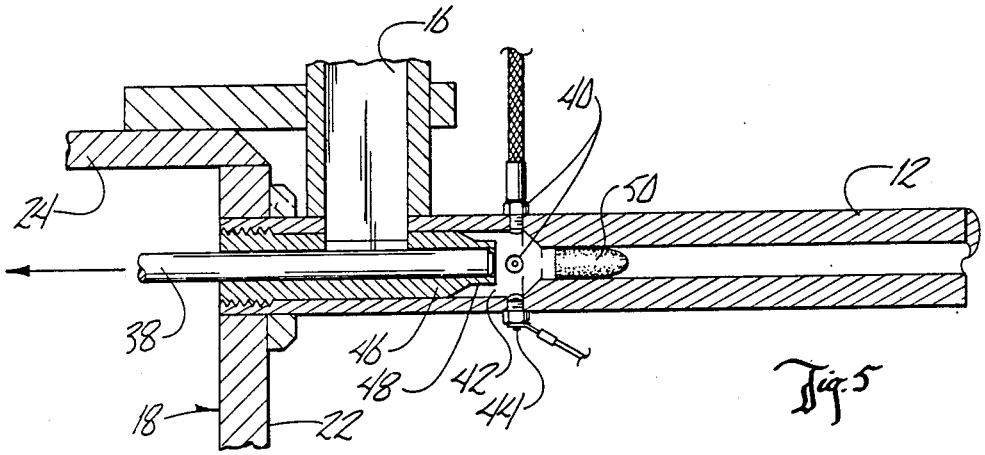
FIG. 5 is a view similar to FIGS. 3 and 4 showing the feeder pin having been retracted to provide a combustion chamber between the shell and the forward end of the feeder pin.

It can be seen in operation that in FIGS. 3–5 the feeder pin 38 in FIG. 3 has been retracted and a shell 50 has moved into the barrel 12 from the shell feeder guide 16. In FIG. 4 the feeder rod 38 has moved to a forward position moving the shell 50 to its position ready to be fired. In FIG. 5 the feeder pin 38 has been retracted to a position where the fuel may be injected and the ignition plug 44 may be ignited causing the shell 50 to fire. The timed sequential operation of the gun in response to the rotation of the wobble plate 30 causes each of the barrels to fire shells in successive order.

Figure 7:
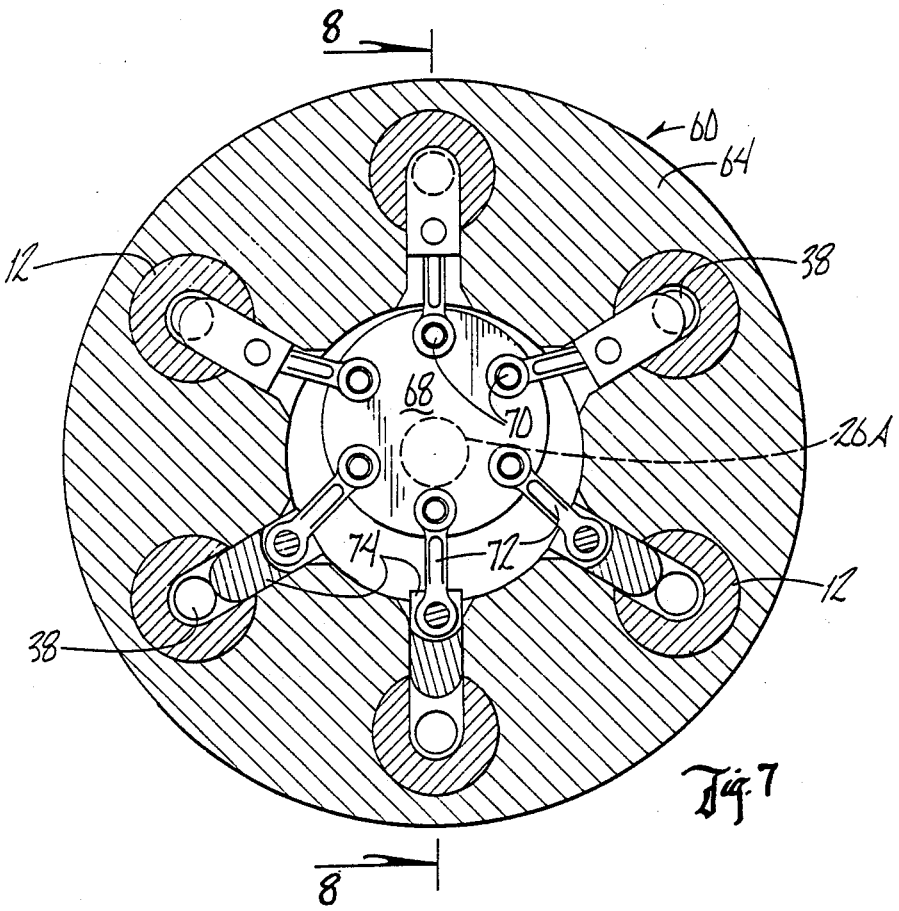
FIG. 7 is a cross-sectional view through the back pressure cut-off drive assembly of an alternate embodiment taken along line 7—7 in FIG. 8.
Figure 8:
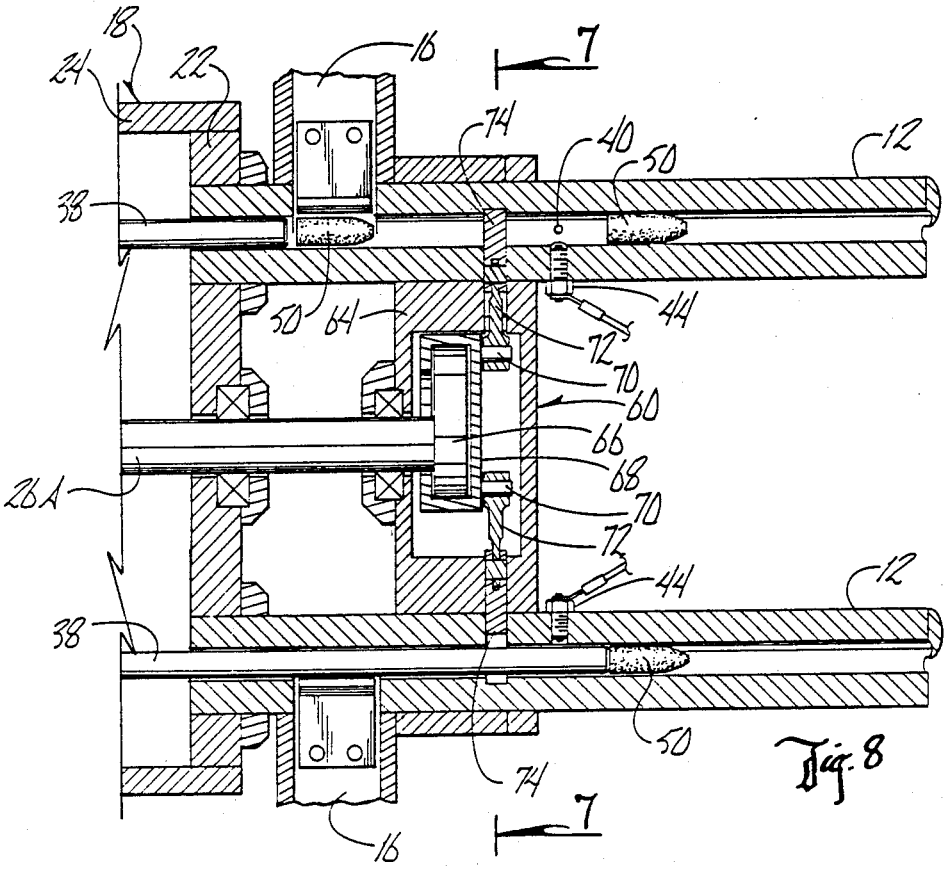
FIG. 8 is a cross-sectional view taken along line 8—8 in FIG. 7.

In FIGS. 7 and 8 an alternative embodiment is shown wherein the back pressure sleeve 46 has been replaced by a back pressure cut-off rod assembly 60 which includes a drive shaft 26A which extends forwardly of the wobble plate drive assembly forward wall 22 and into a support wall 64 where the shaft 26A terminates in an eccentric cam 66 which rotates in a nonrotating enclosure 68. The enclosure 68 in turn in connected by forwardly extending pins 70 to linkage arms 72 in turn connected to cut-off rods 74 which move between open and closed positions as seen in FIGS. 7 and 8 as the shaft 26A is rotated. Thus it is seen that all components are kept in timed relationship by being driven by a common drive shaft 26A and as seen in FIG. 8, the cut-off pin 74 extends across the barrel 12 when the shell 50 is in position to be fired but when the feeder pin 38 at the bottom of FIG. 8 is moving forwardly to position the shell, the cut-off pin 74 is retracted. In this embodiment all pressure is taken off the feeder pins during the firing of the liquid fuel.

What is claimed is:

1. A multiple barrel gun, comprising:
   - a plurality of parallel barrels arranged in a cylinder and having forward and rearward ends,
   - a shell feeder rod moveably received in the rear of each barrel,
   - shell feeding means for providing shells to each barrel forwardly of said feeder rod,
   - a rotatable wobble plate connected to each of said feeder rods, and
   - a power means connected to said wobble plate for rotating said plate and reciprocally moving said feeder rods in and out of said barrels for moving said shell into a firing position and then moving to a retracted loading position for another shell to be fed into said barrel from said shell feeding means.

2. The gun of claim 1 wherein a liquid fuel injection means provides fuel to each barrel forwardly of said shell feeding means and rearwardly of said shell when in said firing position.

3. The gun of claim 2 and an ignition means is provided for each barrel for firing said fuel.

4. The gun of claim 1 wherein said feeder rod has a forward end which functions as the rear end of a combustion chamber for said fuel and the rear end of said shell being the forward end of said combustion chamber.

5. The gun of claim 4 and a back pressure seal sleeve embraces each feeder rod.

6. The gun of claim 5 wherein said sleeve has a sidewall thickness which tapers forwardly to a reduced wall thickness to allow combustion chamber pressures to press said tapered wall sealingly against said feeder rod.

7. The structure of claim 1 and a back pressure cut-off means closes off each barrel forwardly of said feeder rod just prior to a shell being fired thereby insulating said feeder rod from back pressure of a shell being fired.

8. The gun of claim 7 wherein said cut-off means includes a cut-off element transversely positioned relative to said barrel and moveable between open and closed positions with said element extending across said barrel in said closed position and being withdrawn from said barrel in said open position.

9. The gun of claim 8 wherein said cut-off elements are operatively connected to a rotating cam means which reciprocates said elements into and out of said barrels.

10. The gun of claim 9 wherein said cam means includes a cam element in a nonrotating enclosure and said cut-off elements are operatively connected to said nonrotating enclosure whereby said cut-off elements alternately move in and out of said barrels.

11. The gun of claim 10 wherein said power means includes a power shaft which extends between said wobble plate and said cam and rotate together in timed relation for said feeder rod to be withdrawn to said retracted position when said cut-off pin is in said closed position and said feeder pin when in a forward position said cut-off element is in an open position.

12. The gun of claim 11 wherein said cam is an eccentrically mounted on said power shaft.

* * * * *